United States Patent [19]

Starke

[11] Patent Number: 4,683,613

[45] Date of Patent: Aug. 4, 1987

[54] SEPARABLE HINGE WITH SELF RETAINING HINGE PIN

[75] Inventor: Roy R. Starke, Palm Beach Gardens, Fla.

[73] Assignee: The United States of America as represented by the Secretary of the Air Force, Washington, D.C.

[21] Appl. No.: 866,807

[22] Filed: May 27, 1986

[51] Int. Cl.[4] ..... E05D 7/10

[52] U.S. Cl. ..... 16/262; 16/266; 16/380; 16/386

[58] Field of Search ..... 16/262, 266, 380, 381, 16/386

[56] References Cited

U.S. PATENT DOCUMENTS

| | | | |
|---|---|---|---|
| 127,425 | 6/1872 | Norton | 16/266 |
| 167,537 | 9/1875 | Isham . | |
| 306,458 | 10/1884 | Atkinson . | |
| 737,360 | 8/1903 | Daly | 16/381 X |
| 1,030,801 | 6/1912 | Berault | 16/380 X |
| 1,372,242 | 3/1921 | Mepsted . | |
| 2,926,382 | 3/1960 | Knese et al. | 16/176 |
| 3,497,906 | 3/1970 | McFadden | 16/169 |
| 3,744,085 | 7/1973 | Griego | 16/144 |

OTHER PUBLICATIONS

Model Aviation, vol. 10, No. 4, Apr. 1984, p. 41.

*Primary Examiner*—Fred Silverberg

*Attorney, Agent, or Firm*—Richard J. Donahue; Donald J. Singer

[57] ABSTRACT

A hinge assembly wherein the hinge pin and the first two of the interleaved hinge fingers are configured such that, once the pin has been installed and the hinge is in an operating position, the hinge pin is positively retained without the need for additional securing hardware.

1 Claim, 4 Drawing Figures

SEPARABLE HINGE WITH SELF RETAINING HINGE PIN

STATEMENT OF GOVERNMENT INTEREST

The invention described herein may be manufactured and used by or for the Government for governmental purposes without the payment of any royalty thereon.

BACKGROUND OF THE INVENTION

This invention relates generally to hinges and more specifically to a separable hinge having a self retaining hinge pin.

Numerous applications exist where it is necessary or highly desirable to join parts by means of a hinge and thereby permit motion therebetween in one plane, while at the same time having the capability of quickly and easily separating the parts by simply removing the hinge pin. For example, in some aircraft it is desirable to hinge the various control surfaces, such as the aelerons, rudder, elevator, flaps, trim tabs, engine exhaust nozzle flaps and the like, to adjacent structure in a manner whereby such control surfaces can be easily removed for inspection, repair or replacement. One of the problems, however, which must be assuredly avoided in the application described above is the unexpected separation of the hinged parts due to the falling out or working out of the hinge pin as a result of gravitational or other axial forces acting thereon.

As mentioned in U.S. Pat. No. 3,497,906 issued to E. J. McFadden on Mar. 3, 1970, various means are presently known to retain a hinge pin in a hinge pin bore, such as by riveting the hinge pin in place, by upsetting the surrounding portion of the hinge pin bore, by enlarging the end of the hinge pin by heating and peening, by threading a closure plug into the end of the hinge pin bore above the hinge pin, by threading the hinge pin and bore and passing a cotter pin through the hinge pin and adjacent hinge element to prevent unthreading of the hinge pin, or by extending a hinge pin through the hinge pin bore and placing a nut or other retaining means on the end thereof.

There are many objections and drawbacks to the above-mentioned means for retaining a hinge pin in a hinge pin bore. For example, because of the high tensile strength and hardness of the hinge material and the hinge pin material, threading or perforating thereof is a difficult and expensive operation. Heating the hinge pin or the surrounding hinge material for peening into position is undesirable because of the deleterious effect on the materials involved. Nuts have a tendency to work loose, and cotter pins wear through or are sheared off. Furthermore, heavy blows or jars may loosen and dislodge such fastening means.

McFadden in his patent, supra, discloses and claims yet another arrangement for retaining a hinge pin in place, which arrangement is suitable for his particular application. He discloses a hinge wherein a lock-bar, greater in length than the diameter of the hinge pin, is positioned chord-like in a slot across the end of the hinge pin, with the lock-bar extending into recesses located on opposite sides of the hinge pin bore and extending radially outward from the bore. This arrangement necessarily requires the use of an additional pin retaining device in the form of the aforementioned lock-bar, which can be easily lost and is not easily removed once installed in the hinge bore.

As for additional prior art devices which pertain to separable hinges, U.S. Pat. No. 1,372,242 issued to E. Mepsted on Mar. 22, 1921 discloses a locking type pin which may be used with hinges or the like. The pin itself has an eccentric bore therethrough. A locking member which extends through the bore has an enlarged cap or head on one end, and a radial locking projection located in a groove in the shank end of the pin. When the cap is turned or twisted, the radial locking projection is caused to extend beyond the shank end of the pin to a sufficient extent to secure the pin in position.

There are also hinge mechanisms which permit hinged parts to be quickly connected or disconnected by rotation of one hinge part ninety degrees (or some other angle not reached during normal operation of the hinge) with respect to the other hinged part. Such mechanisms generally comprise a hinge pin secured to one hinged part, and slots formed in the wall of the hinge pin bore in the other hinged part. The pin has one or more flats or detents which will fit through the slots when the hinge parts are at a specified angle with respect to one another. Such hinge mechanisms are shown in U.S. Pat. No. 2,926,382 issued to R. H. Knese et al on Mar. 1, 1980, and in an advertisement entitled "DE-HINGE" which appears on page 41 of Model Aviation Magazine, Vol. 10, No. 4, Apr. 1984. It is apparent that the presence of such slots in the wall of the hinge pin bore detract from the strength of the hinge and can adversely affect the durability and smoothness of operation of the device.

Therefore, all of the previously known hinge devices have serious limitations, some having their members permanently joined, some requiring the use of extra securing hardware, such as nuts, washers, cotter pins, locking bars and the like to retain the hinge pin, and yet others lacking strength or durability or being difficult and expensive to manufacture.

OBJECTS AND SUMMARY OF THE INVENTION

It is therefore an object of the present invention to provide a separable hinge having a self retaining hinge pin.

It is another object of the present invention to provide a hinge having a removable and self retaining hinge pin, which is simple to manufacture, relatively inexpensive, and adaptable to heavy duty usage.

It is yet another object of the present invention to provide a separable hinge of novel construction which has great stength, flexibility in application, and fail safe operation.

It is a further object of the present invention to provide a quick disconnect hinge, the portions of which are easily separated by manipulation of parts, but are not subject to inadvertent separation during normal operation.

Still another object of the present invention is to provide a separable hinge which is easy to mount and operate, self contained and requires no maintenance.

In summary, the invention comprises a hinge assembly wherein the hinge pin and the first two of the interleaved hinge fingers are configured such that, once the pin has been installed and the hinge is in an operating position, the hinge pin is positively retained without the need for additional securing hardware. More specifically, the first hinge finger of a first hinge member has a slot therethrough. When the hinge is in a nonoperating assembly position, the slot is aligned with a matching cavity in the next following hinge finger of a second hinge member. During assembly, the hinge pin is passed through the interleaved fingers, and a head or radial projection on the hinge pin passes through the slot and into the aligned cavity. When the hinge members are moved to an operating position, the cavity and slot are not in registration such that the pin head is trapped, and the pin can not be removed from the hinge.

For further objects, advantages and features, and for a more complete understanding of the invention, reference should be made to the following detailed description of the invention and to the accompanying drawings, in which:

DETAILED DESCRIPTION OF THE INVENTION

Figure 1:
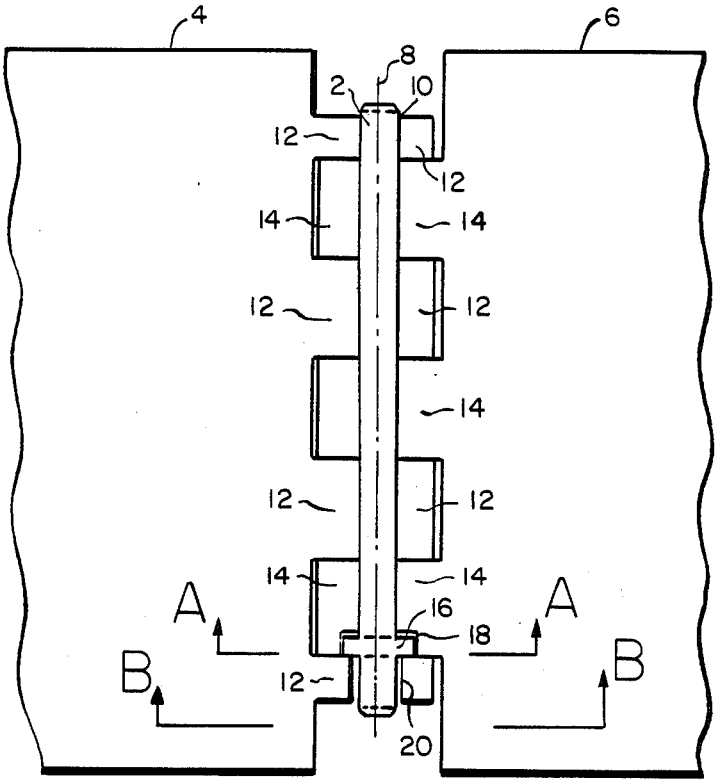
FIG. 1 illustrates a preferred embodiment of the invention in a fully assembled condition.

Referring now to the drawings, and first to FIG. 1 thereof, there is illustrated a sectional view of the preferred embodiment of the invention. This sectional view is taken through the longitudinal axis of the hinge pin 2 when hinge members 4 and 6 are in the same plane. A few dashed lines representing underlying edges of the hinge are intentionally omitted in the various figures of the drawings, while axis and centering lines 8 are included, each for the purpose of simplifying the drawings and aiding in the understanding of the operation thereof. Hinge pin 2 is seen to be positioned within the hinge pin bore 10 formed in the interleaved fingers 12 and 14 of hinge members 4 and 6 respectively. It will be noted that hinge pin 2 has a radial projection or head 16 thereon which nests within a cavity 18 formed in the endmost finger 14 of hinge member 6.

Figure 2:
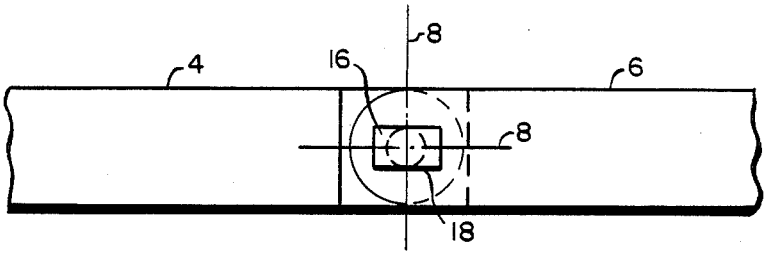
FIG. 2 is a cross-sectional view taken through the line A—A FIG. 1.

FIG. 2, taken through the line A—A of FIG. 1, illustrates the preferred rectangular shape of the head 16 on hinge pin 2, as it is positioned within the mating cavity 18 in hinge member 6.

Figure 3:
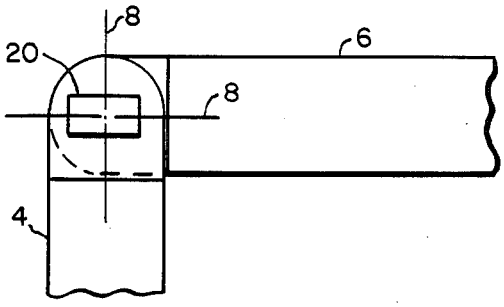
FIG. 3 is a cross-sectional view taken through the line B—B of FIG. 1, showing the hinge pin installation position of the present invention.

FIG. 3 illustrates the hinge members 4 and 6 when rotated to be at right angles to each other. In this position, which is not reached during normal operation of the hinge, a rectangular slot 20 formed in the endmost finger 12 of hinge member 4 is aligned with cavity 18 therebelow such that hinge pin 2 can be inserted therethrough and the rectangular head 16 formed on the shaft of the hinge pin 2 can slide through the slot 20 to nest in cavity 18.

Figure 4:
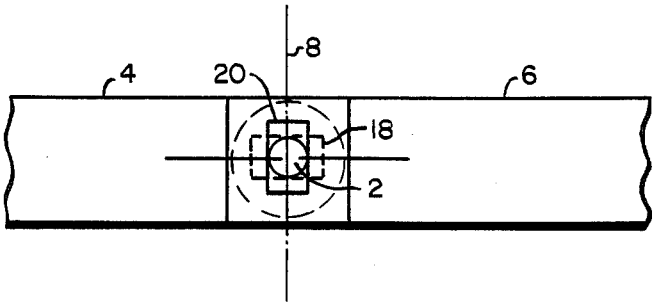
FIG. 4 is a cross-sectional view taken through the line B—B of FIG. 1 showing an operating positon of the hinge members of the present invention.

In FIG. 4, the hinge members 4 and 6 are shown in an operative position, where the slot 20 and cavity 18 are misaligned, thus locking hinge pin 2 in place.

It will be appreciated that the head 16, slot 20 and mating cavity 18 can take shapes other than the rectangular shapes depicted. It is only necessary that such shapes be such as to only permit the hinge pin head 16 to slide through slot 20 and nest cavity 18 when the hinge members 4 and 6 are in a pin installation position or positions.

It will be appreciated that the installation position of the hinge members 4 and 6 need not necessarily be when the hinge members 4 and 6 are at a ninety degree angle, as depicted. Any other non-operative angle or angles may be chosen for the required alignment of cavity 18 and slot 20.

While the invention has been described in terms of its preferred embodiment it is understood that the words which have been used are words of description rather than words of limitation and that changes with in the purview of the apprended claims may be made without departing from the scope and spirit of the invention.

What is claimed is:

1. A separable hinge comprising:

first and second hinge members and a cylindrical hinge pin;

said first and said second hinge members each having a plurality of hinge fingers;

said fingers of said first and of said second hinge members being interleaved;

a hinge pin bore formed through said fingers of said first and of said second hinge members;

said hinge pin having a head spaced from each end of said pin;

said head having a rectangular cross section normal to the longitudinal axis of said pin and symmetrically positioned with respect to said longitudinal axis of said pin;

said head having a first pair of opposed sides separated by substantially the same distance as the diameter of said cylindrical pin, and having a second pair of opposed sides separated by a substantially greater distance than said diameter of said cylindrical pin;

an end of one of said fingers of said first hinge member having a cavity therein adapted to accept said head on said hinge pin;

an end one of said fingers of said second hinge member being adjacent and external to said end one of said fingers of said first hinge member and having a slot in said hinge pin bore therethrough permitting said head on said hinge pin to be inserted therethrough into said cavity only when said first and second hinge members are positioned perpendicular to each other.

* * * * *